US006817406B1

(12) United States Patent
Inoue et al.

(10) Patent No.: US 6,817,406 B1
(45) Date of Patent: Nov. 16, 2004

(54) PLATE TYPE HEAT EXCHANGER

(75) Inventors: Naoyuki Inoue, Tokyo (JP); Toshio Matsubara, Tokyo (JP)

(73) Assignee: Ebara Corporation, Tokyo (JP)

( * ) Notice: Subject to any disclaimer, the term of this patent is extended or adjusted under 35 U.S.C. 154(b) by 0 days.

(21) Appl. No.: 09/926,103

(22) PCT Filed: Mar. 6, 2000

(86) PCT No.: PCT/JP00/01329

§ 371 (c)(1),
(2), (4) Date: Aug. 31, 2001

(87) PCT Pub. No.: WO00/52411

PCT Pub. Date: Sep. 8, 2000

(30) Foreign Application Priority Data

Mar. 4, 1999 (JP) ..... 11/056752
Mar. 12, 1999 (JP) ..... 11/066472
Mar. 15, 1999 (JP) ..... 11/067805

(51) Int. Cl.[7] ..... F28D 3/04
(52) U.S. Cl. ..... 165/115; 165/140; 261/DIG. 11
(58) Field of Search ..... 165/140, 115; 62/484; 261/111, DIG. 11, 112

(56) References Cited

U.S. PATENT DOCUMENTS 2,617,634 A * 11/1952 Jendrassik ..... 165/140
3,997,635 A * 12/1976 Hallgren ..... 261/161
4,372,897 A * 2/1983 Sanderson et al. ..... 261/153
6,176,101 B1 * 1/2001 Lowenstein ..... 62/484

FOREIGN PATENT DOCUMENTS

JP 60-99972 6/1985
JP 60-50634 2/1994
JP 06-050675 A * 2/1994 ..... F28D/1/03
JP 8-159687 6/1996
JP 9-280692 10/1997
JP 10-19415 1/1998
JP 10-206063 8/1998

* cited by examiner

*Primary Examiner*—Allen Flanigan
(74) *Attorney, Agent, or Firm*—Westerman, Hattori, Daniels & Adrian, LLP

(57) ABSTRACT

The present invention relates to a plate heat exchanger for simultaneously exchanging heat between two sets of fluids having different temperatures. The plate heat exchanger comprises a heat exchange element (2) comprising two plates facing each other so as to form a inner sealed space as a passage for a first fluid, and a plate surface of the plate serves as a heat transfer surface, and a fluid flowing along an outer surface of the plate is a second fluid. The plate heat exchanger comprises a heat exchange element (2') comprising two plates facing each other so as to form a inner sealed space as a passage for a third fluid, and a plate surface of the plate serves as a heat transfer surface, and a fluid flowing along an outer surface of the plate is a fourth fluid. A plurality of the heat exchange elements (2) and a plurality of the heat exchange elements (2') are alternately disposed in such a manner that the plate surfaces of the plates are opposed to each other and a predetermined gap is formed between adjacent the heat exchange elements. A communication pipe communicating with the inner spaces of the heat exchange elements (2) and a communication pipe communicating with the inner spaces of the heat exchange elements (2') are formed on the plate surfaces of the heat exchange elements (2) and (2') and integrally formed with the elements.

9 Claims, 14 Drawing Sheets

PLATE TYPE HEAT EXCHANGER

TECHNICAL FIELD

The present invention relates to a plate heat exchanger for exchanging heat between two fluids flowing alternately through adjacent fluid passages between piled plates, and more particularly to a plate heat exchanger suitable for such cases where at least one of the fluids is a low-pressure vapor (or is evaporated with phase change, or is condensed from a vapor), as an evaporator, a low-temperature regenerator, or a condenser in a refrigerating machine using a low-pressure refrigerant.

BACKGROUND ART

FIG. 14 shows a configurational example of an absorber and an evaporator utilizing a conventional plate heat exchanger.

Generally, if a flow velocity of a vapor at an outlet of an evaporator or a flow velocity of a vapor at an inlet of an absorber is not suppressed to about 50 m/s or lower, then flow resistance is increased to lower the performance of a refrigerating machine.

In the conventional example, an evaporator 21 and an absorber 22 are disposed on the left side and the right side, respectively. The size of a passage for vapor with respect to four surfaces of the plates appears as the height of the plate×a gap between the plates/2

Thus, a considerably large gap is required between the plates, and hence it is difficult to achieve compactness. In FIG. 14, the reference numeral 11 denotes cold water, the reference numeral 12 cooling water, the reference numeral 13 a refrigerant liquid, and the reference numeral 14 an absorption solution.

In order to solve this problem, as shown in FIG. 15, there has been proposed a plate heat exchanger in which absorber elements 2' and evaporator elements 2 are alternately disposed in such a manner that adjacent plate surfaces of the elements are opposed to each other. In this case, the size of a passage for vapor with respect to four surfaces of the plates appears as the height of the plate×the width of the plate Therefore, the gap between the plates can be designed without the influence of the flow velocity of the vapor, for thereby achieving compactness.

With such a type of heat exchanger as shown in FIG. 15, it is necessary to combine two plates into a heat exchange element, one by one, and then to attach each of the heat exchange elements to a header for cold water and a header for cooling water, one by one. Thus, many man-hours are needed to manufacture the heat exchanger. In this example, the heat exchange element and the header for cold water (or the header for cooling water) are prepared as separate components. Therefore, in the case of 100 heat exchange elements, it is necessary to bond the heat exchange elements to the header at 200 points for the inlets and the outlets. Further, the absorber and the evaporator are different in shape, so that many types of components are required.

Furthermore, in the case where the absorber elements and the evaporator elements are alternately disposed, for example, the absorption solution 14 and the refrigerant liquid 13 simultaneously flow downwardly through the gap between the elements, with scattering droplets thereof. If the absorption solution is mixed into the refrigerant, then the contamination of the refrigerant causes elevation of boiling point to rise the evaporating temperature, thereby deteriorating the performance of the refrigerating machine. Further, the amount of the solution on the heat transfer surface is reduced, so that the heat transfer surface is difficult to be wet.

On the other hand, if the refrigerant liquid is scattered as droplets from the heat transfer surface of the evaporator and introduced into the absorber, then the concentration of the solution is decreased to lower the absorbing ability of the solution, thereby deteriorating the performance of the refrigerating machine. Further, when the refrigerant liquid jumps out in liquid phase without evaporating, the refrigerating machine cannot obtain the inherent refrigerating effect, resulting in lowered efficiency. Further, the amount of the refrigerant liquid on the heat transfer surface is reduced, so that the heat transfer surface is difficult to be wet.

DISCLOSURE OF THE INVENTION

The present invention has been made in view of the above prior art. It is an object of the present invention to provide a plate heat exchanger which can be manufactured at reduced cost of production and assembly from a small number of components, can prevent a droplet from being scattered during supply of a liquid between heat exchange elements, and can flow the liquid on a plate evenly to obtain high efficiency of heat exchanging performance.

In order to achieve the above object, according to a first aspect of the present invention, there is provided a plate heat exchanger for simultaneously exchanging heat between two sets of fluids having different temperatures, characterized in that: the plate heat exchanger comprises: a heat exchange element (A) comprising two plates facing each other as a set so as to form a sealed inner space therebetween as a passage for a first fluid, wherein a plate surface of the plate serves as a heat transfer surface, and a fluid flowing along an outer surface of the plate is a second fluid; and a heat exchange element (B) comprising two plates facing each other as a set so as to form a sealed inner space as a passage for a third fluid, wherein a plate surface of the plate serves as a heat transfer surface, and a fluid flowing along an outer surface of the plate is a fourth fluid; a plurality of the heat exchange elements (A) and a plurality of the heat exchange elements (B) are alternately disposed in such a manner that the plate surfaces of the plates are opposed to each other and a predetermined gap is formed between adjacent the heat exchange elements; and a communication pipe communicating with the inner spaces of the heat exchange elements (A) and a communication pipe communicating with the inner spaces of the heat exchange elements (B) are formed on the plate surfaces of the heat exchange elements (A) and (B) and integrally formed with the elements.

In the plate heat exchanger, the communication pipe communicating with the elements may be constituted by a part of the plate in the element. The two elements (A) and (B) alternately disposed may have the same shapes that are symmetrical in the opposite direction.

In the plate heat exchanger, the first fluid may be cooling water, the second fluid may be an absorption solution, the third fluid may be cold water, and the fourth fluid may be a refrigerant liquid to constitute a plate-type absorber and a plate-type evaporator for an absorption refrigerating machine. Further, the first fluid may be a heat source fluid (such as hot water or vapor), the second fluid may be an absorption solution, the third fluid may be cooling water, and the fourth fluid may be a refrigerant condensate to constitute a plate-type regenerator and a plate-type condenser for an absorption refrigerating machine. Furthermore, the plate-type absorber and evaporator and/or the plate-type regenerator and condenser may be used as an absorber, an evaporator, a regenerator, and a condenser in an absorption refrigerating machine to constitute an absorption refrigerating machine.

According to a second aspect of the present invention, there is provided a plate heat exchanger for simultaneously exchanging heat between two sets of fluids having different temperatures, characterized in that: the plate heat exchanger comprises: a heat exchange element (A) comprising two plates facing each other as a set so as to form a sealed inner space therebetween as a passage for a first fluid, wherein a plate surface of the plate serves as a heat transfer surface, and a fluid flowing along an outer surface of the plate is a second fluid; and a heat exchange element (B) comprising two plates facing each other as a set so as to form a sealed inner space as a passage for a third fluid, wherein a plate surface of the plate serves as a heat transfer surface, and a fluid flowing along an outer surface of the plate is a fourth fluid; a plurality of the heat exchange elements (A) and a plurality of the heat exchange elements (B) are alternately disposed in such a manner that the plate surfaces of the plates are opposed to each other and a predetermined gap is formed between adjacent the heat exchange elements; and scatter preventive means for preventing a droplet from being scattered is provided in the gap.

Preferably, in the plate heat exchanger, a communication pipe communicating with the inner spaces of the heat exchange elements (A) and a communication pipe communicating with the inner spaces of the heat exchange elements (B) are formed on the plate surfaces of the heat exchange elements (A) and (B). Further, the scatter preventive means may be constituted by two plates so as to return a scattered liquid to the heat transfer surface on which the liquid has been scattered.

Further, in the plate heat exchanger of the present invention, the communication pipe communicating with the elements may be constituted by a part of the plate in the elements. The two heat exchange elements (A) and (B) alternately disposed may have the same shapes that are symmetrical in the opposite direction. Furthermore, a liquid distributor for the second fluid and/or the fourth fluid may be disposed on the outer surface of the plate in the heat exchange element (A) and/or the heat exchange element (B).

According to a third aspect of the present invention, there is provided a plate heat exchanger for simultaneously exchanging heat between two sets of fluids having different temperatures, characterized in that: the plate heat exchanger comprises: a heat exchange element (A) comprising two plates facing each other as a set so as to form a sealed inner space therebetween as a passage for a first fluid, wherein a plate surface of the plate serves as a heat transfer surface, and a fluid flowing along an outer surface of the plate is a second fluid; and a heat exchange element (B) comprising two plates facing each other as a set so as to form a sealed inner space as a passage for a third fluid, wherein a plate surface of the plate serves as a heat transfer surface, and a fluid flowing along an outer surface of the plate is a fourth fluid; a plurality of the heat exchange elements (A) and a plurality of the heat exchange elements (B) are alternately disposed in such a manner that the plate surfaces of the plates are opposed to each other and a predetermined gap is formed between adjacent the heat exchange elements; and a liquid distributor for flowing the second fluid and the fourth fluid onto upper portions of surfaces of the heat exchange elements (A) and (B) is provided in the gap.

In the plate heat exchanger, a gutter having an orifice hole in a side surface thereof may be used as the liquid distributor. Further, the liquid distributor may be in the form of a gutter, and the plate surface may be utilized as a side surface of the gutter.

Preferably, a communication pipe communicating with the inner spaces of the heat exchange elements (A) and a communication pipe communicating with the inner spaces of the heat exchange elements (B) are formed on the plate surfaces of the heat exchange elements (A) and (B).

BRIEF DESCRIPTION OF THE DRAWINGS

FIG. 2A is a plan view, and FIG. 2B is a cross-sectional view taken along a line A—A' of FIG. 2A;

FIG. 3A is a perspective view, and FIG. 3B is a cross-sectional view taken along a line A—A of FIG. 3A;

FIG. 4A is a perspective view, and FIG. 4B is a cross-sectional view taken along a line A—A of FIG. 4A;

FIG. 8A is a front view, and FIG. 8B is a plan view;

FIG. 13A is a front view, and FIG. 13B is a partial plan view;

BEST MODE FOR CARRYING OUT THE INVENTION

Figure 1:
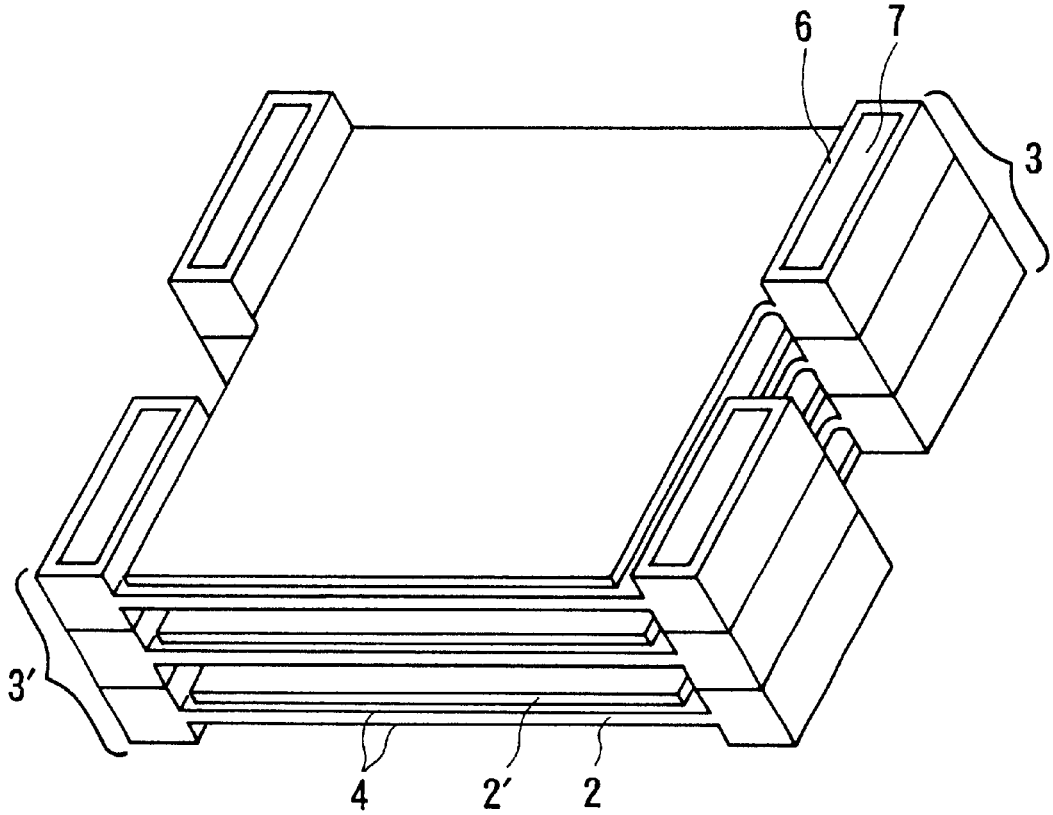
FIG. 1 is a perspective view showing an example of a plate heat exchanger according to a first embodiment of the present invention.

A plate heat exchanger according to a first embodiment of the present invention will be described below in detail.

As a plate used in the present invention, a plate having a shape suitable for meeting the following conditions can be used: Two plates having projections and depressions are piled on each other to form a space therebetween. When the peripheral portions of the plates and communication pipes having opening portions at both ends of the plates (an inlet and outlet for fluid) are simply piled, the plates are brought into light contact (i.e., line contact) with each other along the whole peripheries. When a force in a direction of piling is increased, the contacting portions are changed in shape to be brought into surface contact with each other. When the force is increased until the projections and depressions of the respective plates are brought into contact with each other, the area of the contact surface is increased, and hence the peripheries of the plates can be sealed by brazing.

In the case of brazing, plates are brazed while a force is being applied in order to bring the plates into close contact with each other. Accordingly, the aforementioned plates are preferable because, upon application of this force, the peripheral portions of the plates become parallel, and further the projections and depressions of the plates are brought into contact with each other.

When the two plates described above are piled on each other while a brazing filler material is laid (applied) at portions to be brought into contact with each other, a heat exchange element which has a fluid passage between the opening portions formed at both ends of the plates and the aforementioned space is formed.

The present invention can be applied to not only a case of brazing, but also a case where a gasket is interposed between the plates and a force is applied from the outside, and a case where the plates are sealed by welding.

The projections and depressions of the plate according to the present invention can be formed as a corrugated pattern extending in a predetermined direction, and hence a complicated passage curved two-dimensionally can be formed with a relatively simple arrangement.

Between the heat exchange elements having the same passage, another heat exchange element having another passage is disposed. Therefore, the communication pipe has such a length as to provide a spacing in which the element can be disposed and a spacing for forming a passage on the outer surface of the plate. The communication pipe may be provided at one side of both ends of the plate.

One of the communication pipes having the opening portions at both ends of the plate is provided with a rising portion, so that positioning of the plates upon piling can be facilitated by the fitting of the opening portions. Thus, the two-dimensional positioning of the plates can naturally be performed by simply piling the plates on each other. Consequently, the manufacturing process can be simplified.

A plate heat exchanger according to the first embodiment of the present invention will be described below in detail with reference to FIGS. 1 through 5.

FIG. 1 is a perspective view showing an example of a plate heat exchanger according to the present invention. The plate heat exchanger is constituted by heat exchange structures 3, 3', i.e., three heat exchange elements 2 and three exchange elements 2' which are alternately bonded to each other.

The heat exchange element 2 is constructed in such a manner that two plates 4 are piled, and contacting portions having projections and depressions and peripheral portions of the plates are fixed to each other by welding or brazing. The heat exchange element 2' is constructed in such a manner that two plates 4 are piled, and contacting portions having projections and depressions and peripheral portions of the plates are fixed to each other by welding or brazing.

In this example, the three heat exchange elements 2 and the three heat exchange elements 2' are piled in opposite directions to form the heat exchange structures 3, 3'. The communication pipes 6 having the opening portion 7 are fixed to each other by welding or brazing at a time. Specifically, the heat exchange structure 3 is constituted by the three heat exchange elements 2, and the heat exchange structure 3' is constituted by the three heat exchange elements 2'. The heat exchange elements 2 and the heat exchange elements 2' are alternately piled on each other in opposite directions.

Figure 2A:
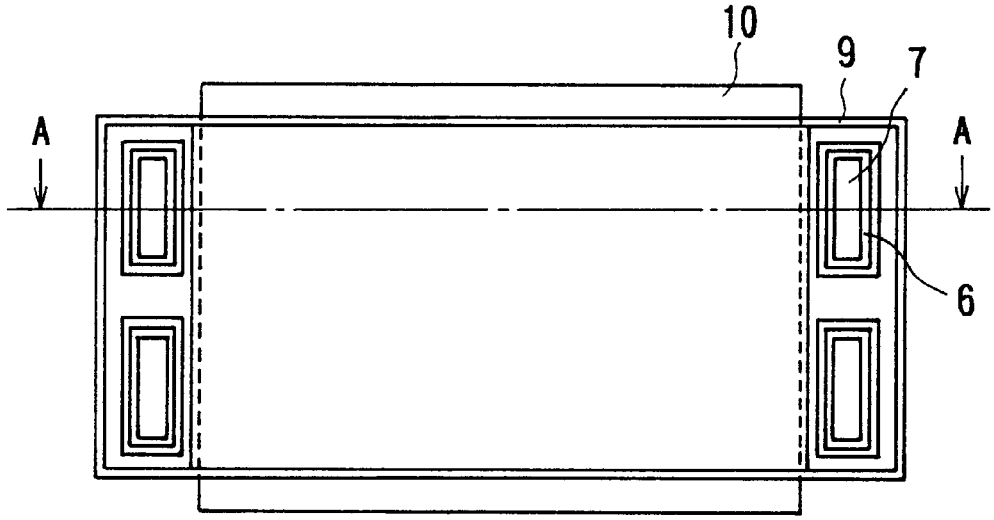
FIGS. 2A and 2B are schematic views explanatory of manufacturing the plate heat exchanger shown in FIG. 1.
Figure 2B:
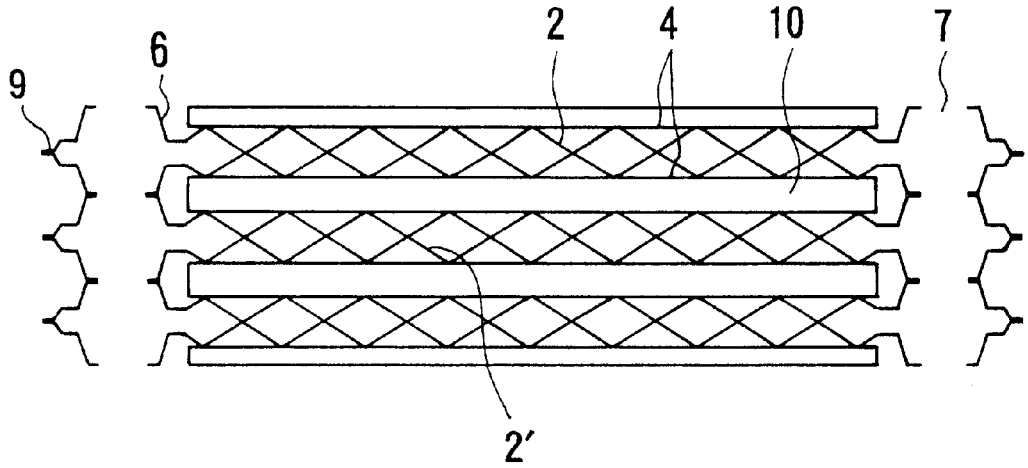

FIGS. 2A and 2B show schematic views explanatory of manufacturing the plate heat exchanger shown in FIG. 1 at a time. FIG. 2A is a plan view, and FIG. 2B is a cross-sectional view taken along a line A—A of FIG. 2A. The heat exchange elements 2 each comprising two plates piled on each other and the heat exchange elements 2' each comprising two plates piled on each other are piled in opposite directions so that the opening portions communicate with each other.

At this time, a spacer 10 is disposed between the adjacent heat exchange elements for heating an intermediate portion while a load is being applied thereto. With this arrangement, the two plates can be brazed to be combined with each other, and further all components can be brazed to be combined with each other at a time.

Preferably, the spacer comprises a material that is free from a thermal change and is not brazed. For example, a graphite material may be used as the spacer. The surface of the spacer may be coated with a release agent beforehand in order to make sure not to be brazed.

As described above, a brazing filler material is laid between the contacting portions and/or the contacting surfaces, and the plates and the spacers are piled on each other. Then, the plates are heated in a furnace, while a force is being applied in the direction of piling (a weight is placed thereon), to braze the plates at a time. Thus, a heat exchanger is produced by a single step, so that the number of components is reduced to remarkably simplify the manufacturing process.

Figure 3A:
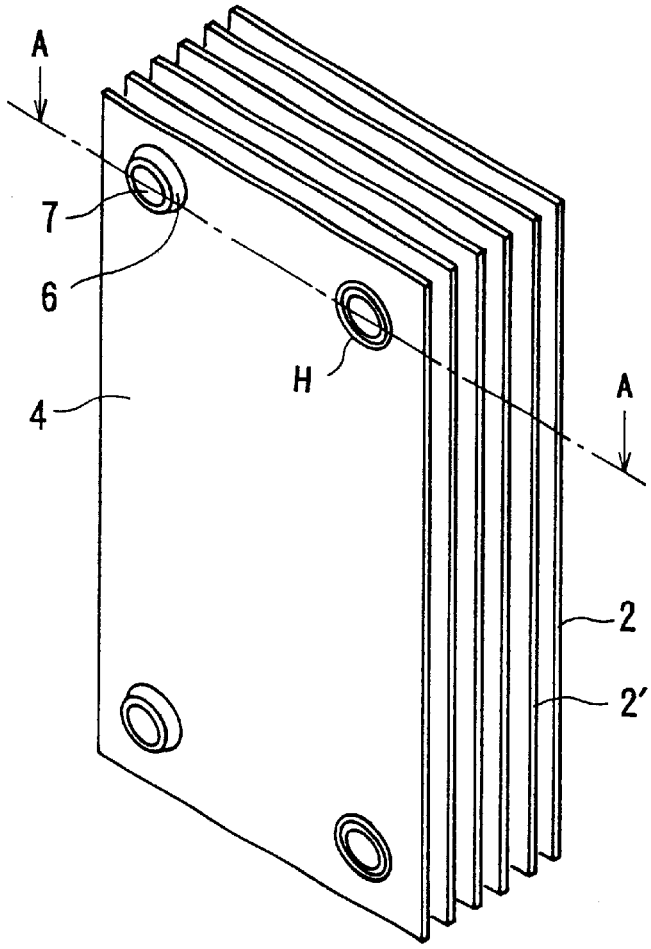
FIGS. 3A and 3B show another example of a plate heat exchanger according to the first embodiment of the present invention.
Figure 3B:
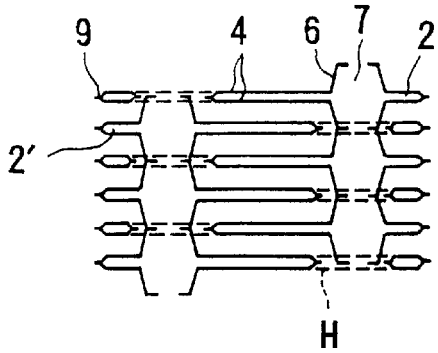

FIGS. 3A and 3B show another example of a plate heat exchanger according to the present invention, and FIG. 3A is a perspective view, and FIG. 3B is a cross-sectional view taken along a line A—A of FIG. 3A.

In FIGS. 3A and 3B, a hole is formed in a plate as a communication pipe 6 having an opening portion 7 in the plate, instead of forming a notch in the plate shown in FIG. 1. A portion H indicated by broken lines has a hole of a diameter greater than the outer diameter of the communication pipe 6 so as to pass the communication pipe 6 therethrough. This hole is alternately formed on the right side and the left side in every other plate.

Figure 4A:
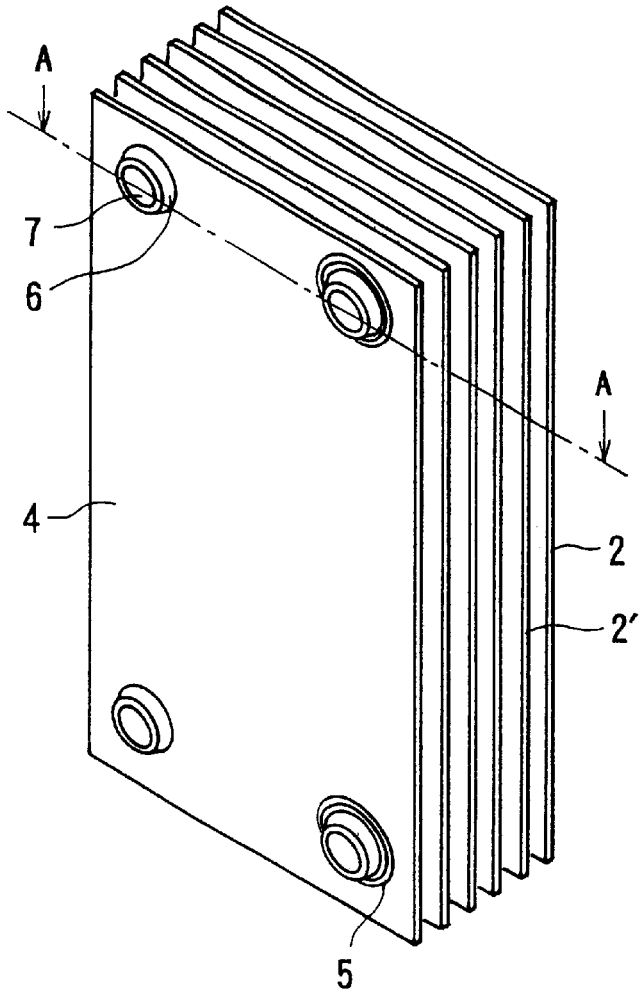
FIGS. 4A and 4B show still another example of a plate heat exchanger according to the first embodiment of the present invention.
Figure 4B:
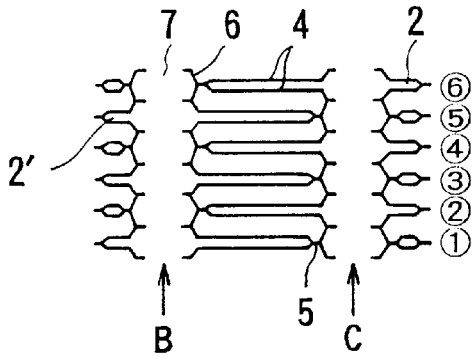

FIGS. 4A and 4B show still another example of a plate heat exchanger according to the present invention, and FIG. 4A is a perspective view, and FIG. 4B is a cross-sectional view taken along a line A—A of FIG. 4A.

In FIGS. 4A and 4B, all communication pipes 6 are connected to each other, instead of forming a notch in the plate shown in FIG. 1 or forming a hole in the plate shown in FIG. 3 as a communication pipe 6 having an opening portion 7 in the plate. A fluid is prevented from flowing into the plate 4. With a flow suppression portion 5, a fluid flowing into B flows through the plates ①, ③, and ⑤, and a fluid flowing into C flows through the plates ②, ④, and ⑥.

Figure 5:
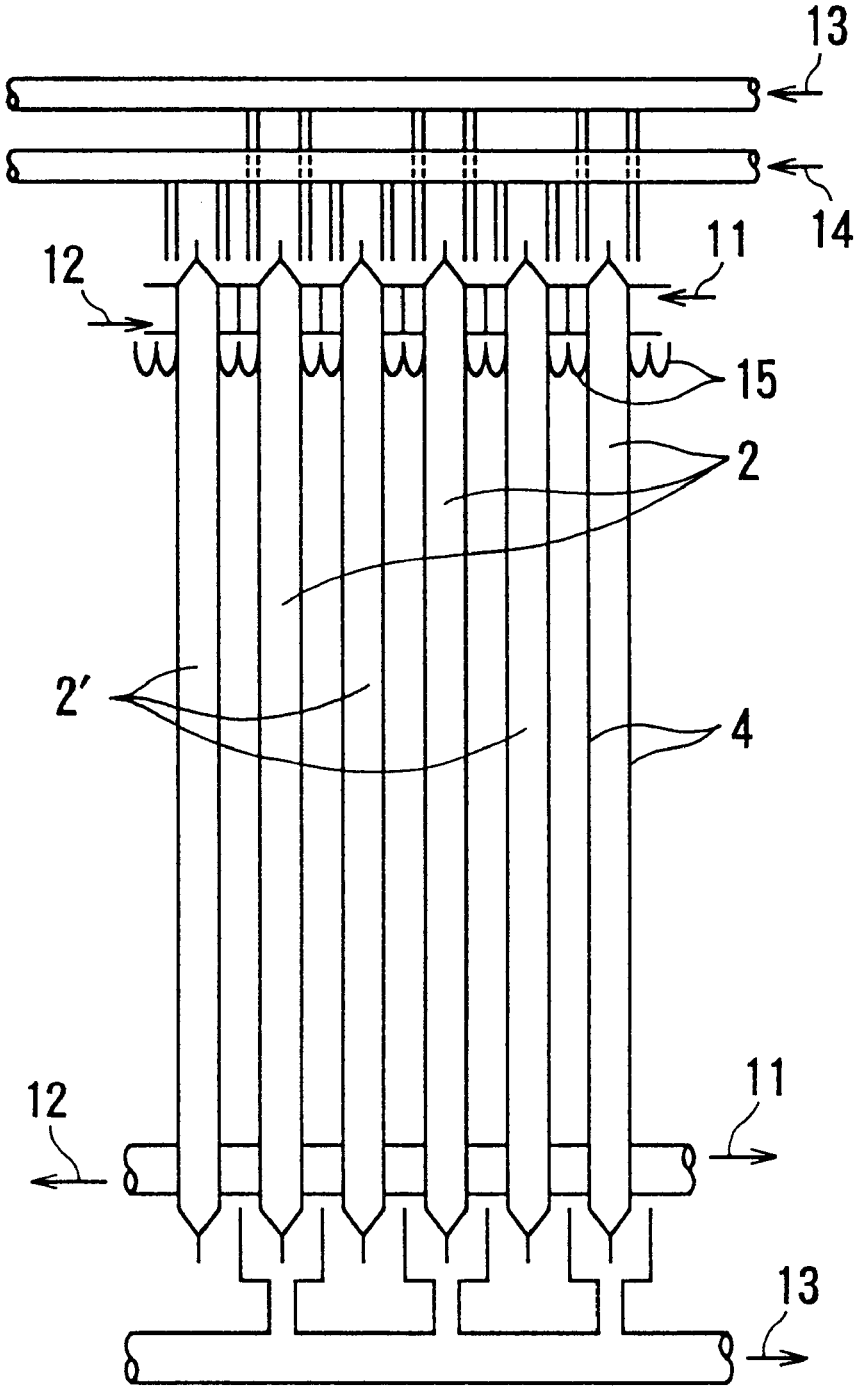
FIG. 5 is a cross-sectional configurational view showing a plate heat exchanger according to the first embodiment of the present invention which is applied to an absorber and an evaporator in an absorption refrigerating machine.

FIG. 5 shows an example in which the plate heat exchanger according to the first embodiment of the present invention is applied to an absorber and an evaporator in an absorption refrigerating machine. In FIG. 5, cold water 11 flows through the interior of a heat exchange element 2, and a refrigerant liquid 13 flows on the outer surface of the plate via a liquid distributor 15. The refrigerant liquid 13 which has not evaporated is received in a lower portion to be recirculated. Cooling water 12 flows through the interior of a heat exchange element 2', and a refrigerant which has evaporated on the outer surface of the plate in the heat exchange element 2 is absorbed into an absorption solution 14 flowing on the outer surface of the plate in the heat exchange element 2' disposed at an opposed position.

When the plate heat exchanger is applied to a combination of a regenerator and a condenser in an absorption refrigerating machine, the reference numeral 11 denotes a heat source fluid, and the reference numeral 12 denotes cooling water. A liquid distributor 15 is provided only on the outer surface of the plate in a heat exchange element 2 to flow an absorption solution. Thus, it is not necessary to provide the liquid distributor 15 on the outer surface of the plate in a heat exchange element 2'. A refrigerant which has evaporated on the outer surface of the plate in the heat exchange element 2 condenses on the outer surface of the plate in the heat exchange element 2' and flows downwardly on the outer surface.

A gutter having orifice holes in a side surface thereof can be used as the liquid distributor, and the outer surface of the plate can be utilized as the side surface of the gutter.

As described above, according to the first embodiment of the present invention, passages curved by projections and depressions are formed inside and outside of heat exchange elements composed of one or two types of components, and simultaneously a complicated plate heat exchanger with high efficiency of heat exchanging performance for exchanging heat between two sets of fluids having different temperatures can be manufactured at low cost from a small number of components by a simple manufacturing process.

Next, a plate heat exchanger in a second embodiment of the present invention will be described below in detail.

As with the first embodiment of the present invention, a plate having a shape suitable for meeting the following conditions can be used as a plate used in the present invention: Two plates having projections and depressions are piled on each other to form a space therebetween. When the peripheral portions of the plates and communication pipes having opening portions at both ends of the plates (an inlet and outlet for fluid) are simply piled, the plates are brought into light contact (i.e., line contact) with each other along the whole peripheries. When a force in a direction of piling is increased, the contacting portions are changed in shape to be brought into surface contact with each other. When the force is increased until the projections and depressions of the respective plates are brought into contact with each other, the area of the contact surface is increased, and hence the peripheries of the plates can be sealed by brazing.

In the case of brazing, plates are brazed while a force is being applied in order to bring the plates into close contact with each other. Accordingly, the aforementioned plates are preferable because, upon application of this force, the peripheral portions of the plates become parallel, and further the projections and depressions of the plates are brought into contact with each other.

When the two plates described above are piled on each other while a brazing filler material is laid (applied) at portions to be brought into contact with each other, a heat exchange element which has a fluid passage between the opening portions formed at both ends of the plates and the aforementioned space is formed.

The present invention can be applied to not only a case of brazing, but also a case where a gasket is interposed between the plates and a force is applied from the outside, and a case where the plates are sealed by welding.

The projections and depressions of the plate according to the present invention can be formed as a corrugated pattern extending in a predetermined direction, and hence a complicated passage curved two-dimensionally can be formed with a relatively simple arrangement.

Between the heat exchange elements having the same passage, another heat exchange element having another passage and a scatter preventive means are disposed. Thus, the communication pipe has such a length as to provide a spacing in which the element and the scatter preventive means can be disposed and a spacing for forming a passage on the outer surface of the plate. The communication pipes may be provided at one side of both ends of the plate. In order to manufacture the heat exchanger, a spacer is disposed between the adjacent elements, and these components can be brazed in a furnace at a time while a force is being applied.

One of the communication pipes having the opening portions at both ends of the plate is provided with a rising portion, so that positioning of the plates upon piling can be facilitated by the fitting of the opening portions. Thus, the two-dimensional positioning of the plates can naturally be performed by simply piling the plates on each other. Consequently, the manufacturing process can be simplified.

The scatter preventive means disposed between the heat exchange elements (A) and (B) according to the present invention may have such a structure that a second fluid and a fourth fluid flow separately in the downward direction on the heat transfer surfaces in the plate surfaces of the elements for preventing droplets of both fluids from being scattered. For example, the scatter preventive means may comprise a baffle constituted by two plates so as to return respective scattered liquids to the heat transfer surfaces on which the liquids have been scattered. The baffle is brought into contact with the projections on the plate surface, and the baffles are brought into contact with each other. The baffle serves as a spacer to apply a load to portions to be brazed, and hence the heat exchanger can be brazed at a time.

A plate heat exchanger according to the second embodiment of the present invention will be described below in detail with reference to FIGS. 6 through 10.

Figure 6:
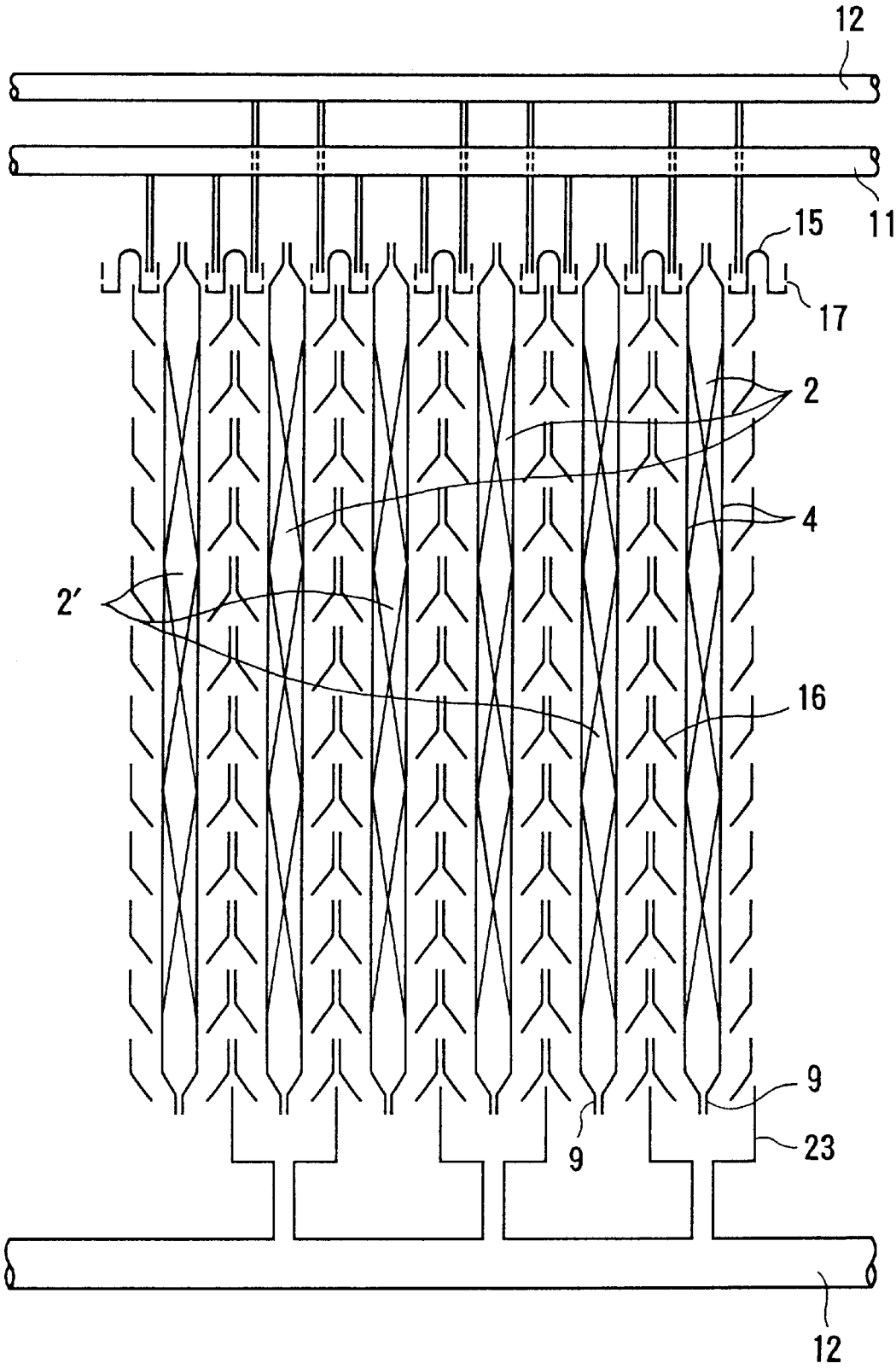
FIG. 6 is a cross-sectional configurational view showing an example of a plate heat exchanger according to a second embodiment of the present invention.

FIG. 6 is a cross-sectional configurational view showing an example of a plate heat exchanger according to the present invention. The plate heat exchanger is constituted by three heat exchange elements 2 and three heat exchange elements 2' which are alternately bonded to each other.

The heat exchange element 2 is constructed in such a manner that two plates 4 are piled, and peripheral portions 9 of the plates are fixed to each other by welding or brazing. The heat exchange element 2' is constructed in such a manner that two plates 4 are piled, and peripheral portions 9 of the plates are fixed to each other by welding or brazing.

Baffles 16 for preventing a fluid flowing on the plate surface from being scattered are disposed between the heat exchange elements 2 and 2'. Liquid distributors 15 are provided above the heat exchange elements 2, 2', and the fluid flows from orifice holes 17 of the liquid distributor along the heat transfer surface of the plate surface.

In the case where the baffles are placed in contact with, or slightly apart from, the heat transfer surface of the plate surface, even if the second fluid 11 or the fourth fluid 12 flowing downwardly from the liquid distributor 15, e.g., an absorption solution 11 or a refrigerant liquid 12, is scattered, the solutions can be prevented from being introduced into the evaporator side or the absorber side. Furthermore, the solutions are returned to the absorber side for thereby maintaining the amount of absorption solution and the amount of refrigerant liquid. The recovered refrigerant liquid 12 can be circulated and supplied.

In FIG. 6, the first fluid is supplied by a communication pipe communicating with the heat exchange elements 2', while the third fluid is supplied by a communication pipe communicating with the heat exchange elements 2, although this is not illustrated. The first fluid may be cooling water, and the third fluid may be cold water, to thus constitute a plate-type absorber and a plate-type evaporator in an absorption refrigerating machine.

When the heat exchanger is applied to a combination of a regenerator and a condenser in an absorption refrigerating machine, cooling water is supplied into the heat exchange element 2 through the communication pipe, and a heat source fluid is supplied into the heat exchange element 2' through the communication pipe. The absorption solution 11 flows on the heat transfer surface of the surface of the heat exchange element 2' via the liquid distributor 15 to evaporate the refrigerant liquid and to condense the evaporated refrigerant on the heat transfer surface of the plate surface of the heat exchange element 2. Thus, it is not necessary to flow the liquid on the heat exchange element 2 from the liquid distributor 15.

Figure 7:
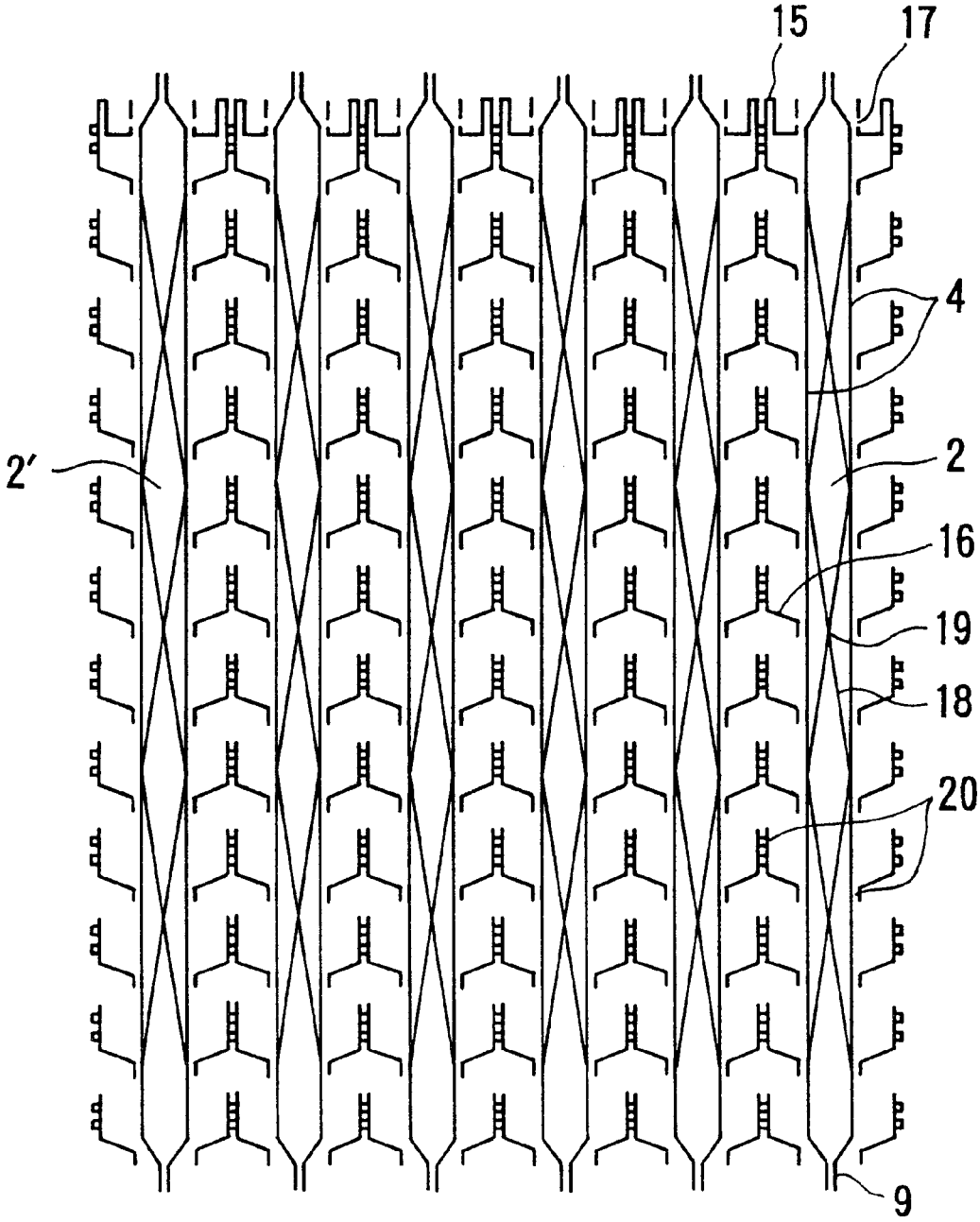
FIG. 7 is a cross-sectional configurational view showing a main part of another example of a plate heat exchanger according to the second embodiment of the present invention.

FIG. 7 shows another cross-sectional configurational view showing a main part of a plate heat exchanger according to the second embodiment of the present invention. In FIG. 7, the plates are brought into contact with each other at peripheral portions 9 of the plates and at intersections 19 of corrugated patterns 18. A baffle 16 is brought into contact with plates 4 and another baffle 16 at contacting portions 20 to serve as a substitute for a spacer between heat transfer elements 2 and 2'. With this arrangement, a load can be applied to portions, to be brazed, of the entire plate 4 upon heating for manufacturing a plate heat exchanger, and the entire heat exchanger can be brazed at a time.

Figure 8A:
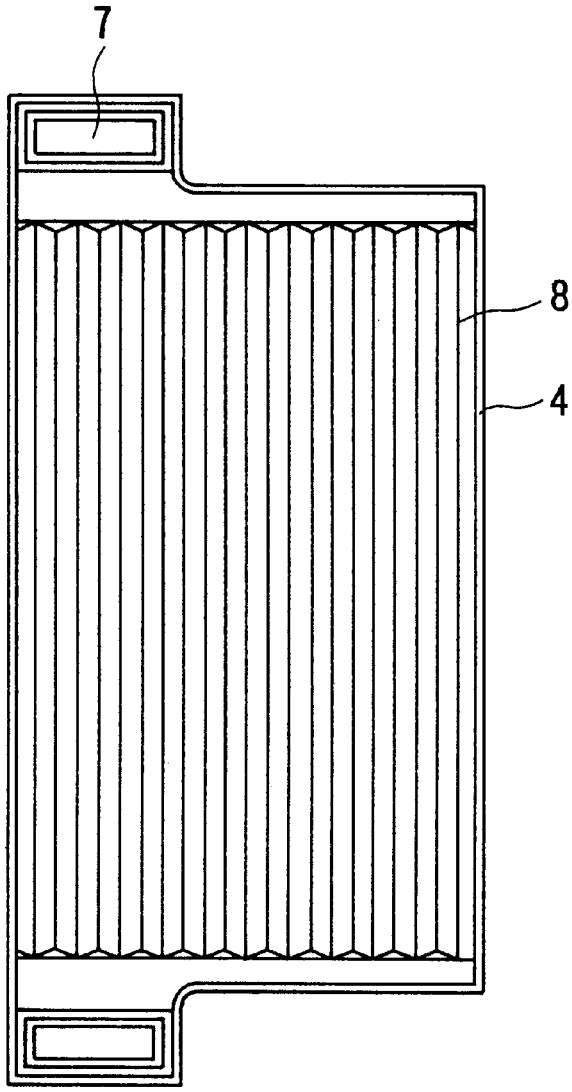
FIGS. 8A and 8B are configurational views showing a surface shape of a plate in a plate heat exchanger according to the second embodiment of the present invention.
Figure 8B:
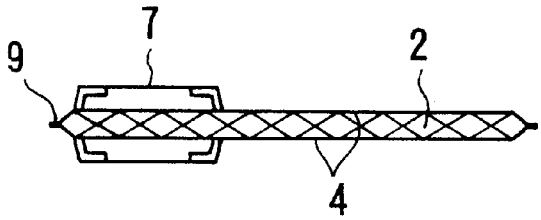
Figure 9:
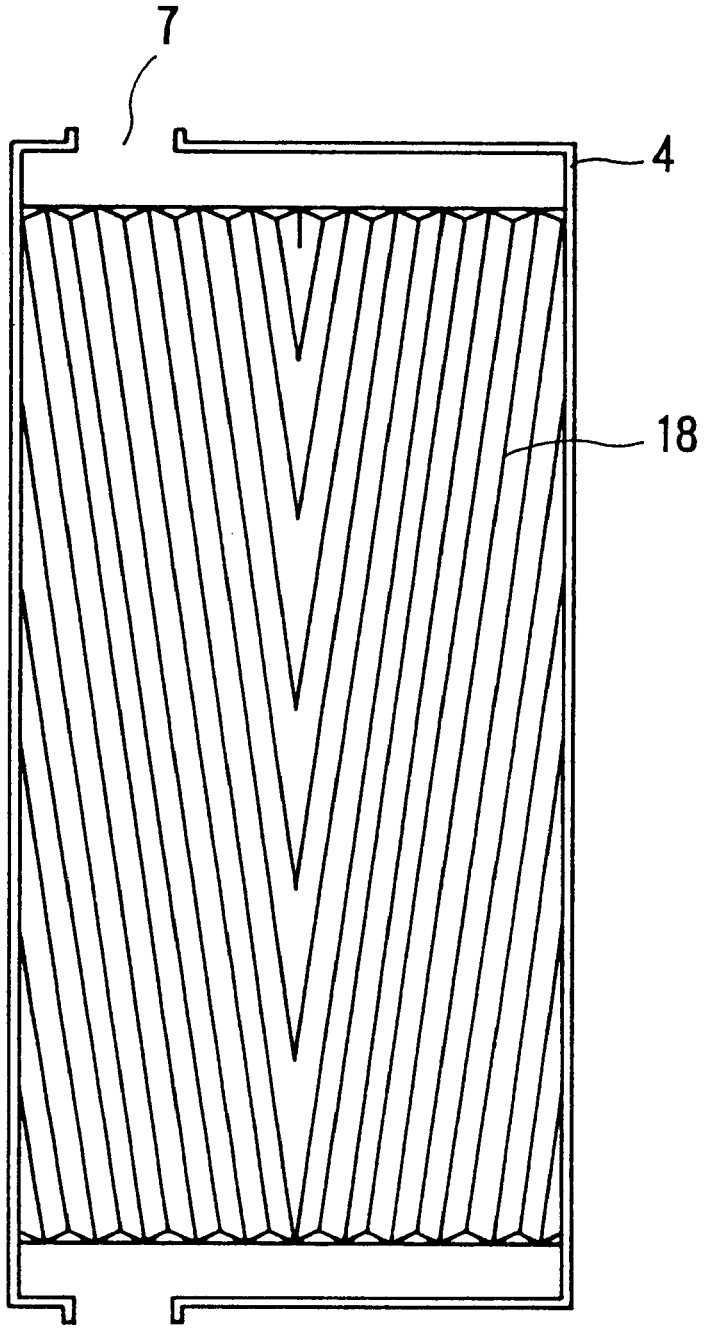
FIG. 9 is a configurational view showing a surface shape of a plate in another plate heat exchanger according to the second embodiment of the present invention.
Figure 10:
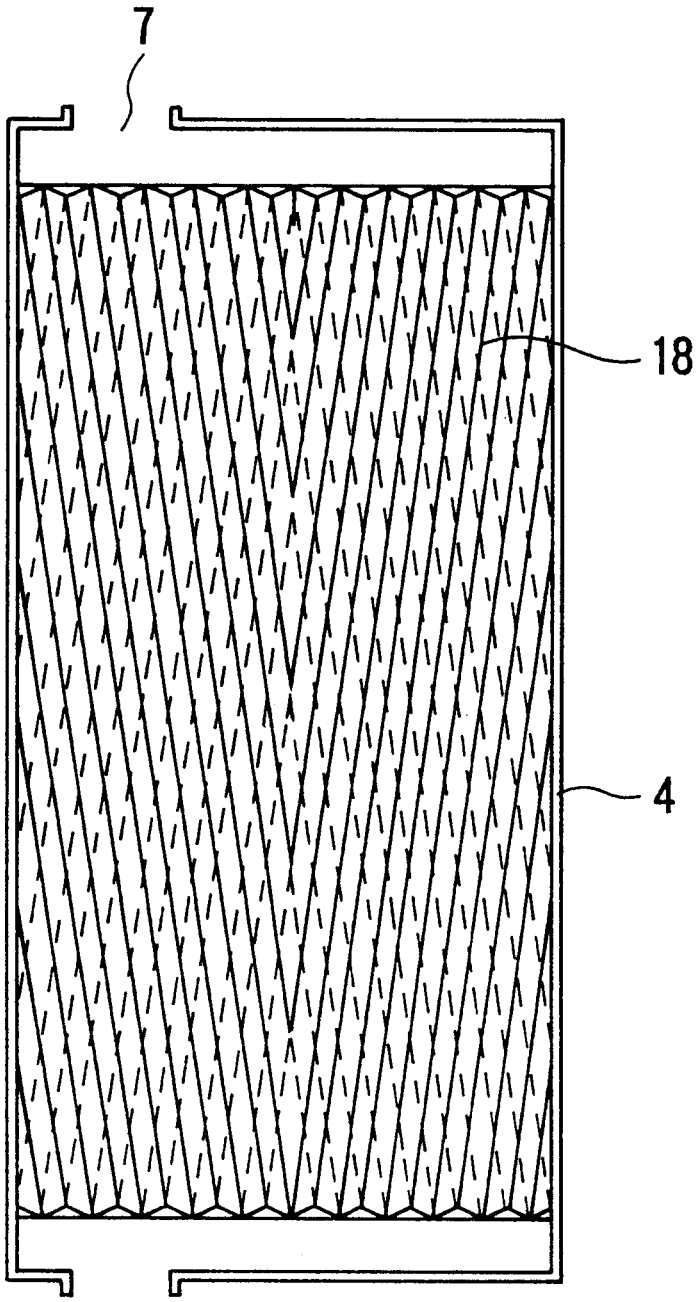
FIG. 10 is a configurational view showing a surface shape of a plate in still another plate heat exchanger according to the second embodiment of the present invention.

FIGS. 8A, 8B, 9 and 10 show heat transfer surface shapes 18 of plate surfaces. In FIGS. 8A and 8B, the heat transfer surface shape 18 of a plate 4 is formed in the vertical direction by corrugations at the depressions and projections. FIG. 8A is a front view, and FIG. 8B is a plan view. In FIGS. 8A and 8B, the reference numeral 7 denotes an opening portion. FIGS. 9 and 10 show a heat transfer surface shape 18 in which corrugations at the depressions and projections are inclined. In FIG. 10, dashed lines represent projections and depressions of a rear plate. In FIGS. 9 and 10, the corrugations are inclined in two directions to form an angular shape. However, the corrugations may be inclined in one direction, or may form a number of angular shapes. As shown in FIGS. 8A, 8B, 9 and 10, the projections and depressions are provided on the heat transfer surface, and the contacting portions of the plates 4 are brazed to increase the strength of the plates. When the projections and depressions are in the form of linear corrugations which are formed in the vertical or nearly vertical direction, the liquid flows on the plate evenly without nonuniformity of the liquid flow.

The heat transfer surface of the plate surface is preferably sandblasted to improve the wettability of the liquid and to widen the range of the liquid flow. In this manner, it is desirable to treat or pre-treat the plate surface for increasing its hydrophilic properties.

As described above, according to the second embodiment of the present invention, passages curved by projections and depressions are formed inside and outside of heat exchange elements composed of one or two types of components, and simultaneously a complicated plate heat exchanger with high efficiency of heat exchanging performance for exchanging heat between two fluids having different temperatures can be manufactured at low cost from a small number of components by a simple manufacturing process.

Further, according to the present invention, since droplets are prevented from being scattered, the two fluids flowing downwardly are not mixed with each other. When the heat exchanger is used as an absorber and an evaporator, or a regenerator and a condenser, in an absorption refrigerating machine, an absorption refrigerating machine with a high heat exchange performance can be obtained without a lowered performance of a refrigerating machine or the problem that the heat transfer surface is difficult to be wet.

A plate heat exchanger according to a third embodiment of the present invention will be described below in detail.

As with the first embodiment of the present invention, a plate having a shape suitable for meeting the following conditions can be used as a plate used in the present invention: Two plates having projections and depressions are piled on each other to form a space therebetween. When the peripheral portions of the plates and communication pipes having opening portions at both ends of the plates (an inlet and outlet for fluid) are simply piled, the plates are brought into light contact (i.e., line contact) with each other along the whole peripheries. When a force in a direction of piling is increased, the contacting portions are changed in shape to be brought into surface contact with each other. When the force is increased until the projections and depressions of the respective plates are brought into contact with each other, the area of the contact surface is increased, and hence the peripheries of the plates can be sealed by brazing.

In the case of brazing, plates are brazed while a force is being applied in order to bring the plates into close contact with each other. Accordingly, the aforementioned plates are preferable because, upon application of this force, the peripheral portions of the plates become parallel, and further the projections and depressions of the plates are brought into contact with each other.

When the two plates described above are piled on each other while a brazing filler material is laid (applied) at portions to be brought into contact with each other, a heat exchange element which has a fluid passage between the opening portions formed at both ends of the plates and the aforementioned space is formed.

The present invention can be applied to not only a case of brazing, but also a case where a gasket is interposed between the plates and a force is applied from the outside, and a case where the plates are sealed by welding.

The projections and depressions of the plate according to the present invention can be formed as a corrugated pattern extending in a predetermined direction, and hence a complicated passage curved two-dimensionally can be formed with a relatively simple arrangement.

Between the heat exchange elements having the same passage, another heat exchange element having another passage and a scatter preventive means are disposed. Therefore, the communication pipe has such a length as to provide a spacing in which the element and the scatter preventive means can be disposed and a spacing for forming a passage on the outer surface of the plate. The communication pipes may be provided at one side of both ends of the plate. In order to manufacture the heat exchanger, a spacer is disposed between the adjacent elements, and thus these components can be brazed in a furnace at a time while a force is being applied.

One of the communication pipes having the opening portions at both ends of the plate is provided with a rising portion, so that positioning of the plates upon piling can be facilitated by the fitting of the opening portions. Thus, the two-dimensional positioning of the plates can naturally be performed by simply piling the plates on each other. Consequently, the manufacturing process can be simplified.

A liquid distributor provided above the surface of the heat exchange element according to the present invention is in the form of a gutter in parallel with the plate surface, and orifice holes for allowing the liquid to flow therethrough downwardly onto the plate surface are provided in a side surface of the liquid distributor. The liquid distributor may utilize the plate surface as a side surface of the gutter. With this arrangement, upon supplying a fluid onto the plate surface, the liquid is prevented from being scattered, so that the liquid flows on the plate surface evenly without nonuniformity of the liquid flow.

A scatter preventive means may be disposed below the liquid distributor between the heat exchange elements (A) and (B) of the present invention. With this arrangement, the fluid supplied onto the plate surface can be prevented more reliably from being scattered. The scatter preventive means may be a baffle comprising two plates so as to return respective scattered liquids to the heat transfer surfaces on which the liquid has been scattered.

In the heat exchange element of the present invention, the fluid flows on the outer surface of the heat exchange element and exchanges heat with the internal fluid via the heat transfer surface of the plate. Thus, the outer surface needs to be highly wettable so that the fluid flowing on the outer surface can spread over the heat transfer surface and eliminate a dry surface. Therefore, the plate having the heat transfer surface of the heat exchange element may be made of stainless steel, and the outer surface of the plate may be provided with a porous layer formed by electrolytic dissolution, a diffusion layer of chromium oxide formed by treatment with a molten salt bath containing chromium, or a large number of small depressions. Alternatively, the outer surface of the plate may be satin finished.

In order to provide a large number of small depressions on the outer surface, a large number of small protrusions on the surface of a mold are transferred to a material for the plate when the plate is molded. A satin finished surface can be formed by using a material having a surface that has been satin finished, for example, a stainless steel material having a surface that has been satin finished by a roller during production of the steel sheet. Alternatively, the satin finished surface can be formed by electric discharge machining of the surface. Electric discharge machining is preferably performed in water, and may be applied to a sheet (raw material) for the plate, or may be performed during the production of a plate heat exchanger after the molding of the plate. If electric discharge machining is applied to the raw material, a pulsed current may be supplied while the electrode in a flat shape is being moved or the sheet is being moved. In this case, the shape of the electrode can be simplified.

A plate heat exchanger according to the third embodiment of the present invention will be described below in detail with reference to FIGS. 6, and 11 through 13.

An example of a plate heat exchanger according to the third embodiment of the present invention has the same structure as the example shown in FIG. 6, and thus will be described with reference to FIG. 6.

As shown in FIG. 6, the plate heat exchanger of the present invention is constituted by three heat exchange elements 2 and three heat exchange elements 2' which are alternately bonded to each other.

The heat exchange elements 2, 2' are constructed in such a manner that two plates 4 are piled, and contacting portions having projections and depressions and peripheral portions 9 are fixed to each other by welding or brazing.

Baffles 16 for preventing a fluid flowing on the plate surface from being scattered are disposed between the heat exchange elements 2 and 2'. Liquid distributors 15 are provided above the heat exchange elements 2, 2', and the fluid flows from orifice holes 17 of the liquid distributor along the heat transfer surface of the plate surface.

In the case where the liquid distributors and the baffles are placed in contact with the heat transfer surface of the plate surface, the second fluid 11 or the fourth fluid 12 flowing downwardly from the liquid distributor 15, e.g., an absorption solution 11 or a refrigerant liquid 12, can be prevented from being scattered and being introduced into the evaporator side or the absorber side. Furthermore, when the baffles are provided, the solutions can be returned to the absorber side, and the refrigerant liquid can be returned to the evaporator side, for thereby maintaining the amount of absorption solution and the amount of refrigerant liquid. Refrigerant pans 23 are provided below the heat exchange elements 2 to recover the refrigerant liquid 12 which has not evaporated. The recovered refrigerant liquid 12 can be circulated and supplied.

In FIG. 6, the first fluid is supplied by a communication pipe communicating with the heat exchange elements 2', while the third fluid is supplied by a communication pipe communicating with the heat exchange elements 2, although this is not illustrated. The first fluid may be cooling water, and the third fluid may be cold water, to thus constitute a plate-type absorber and a plate-type evaporator in an absorption refrigerating machine.

Figure 11:
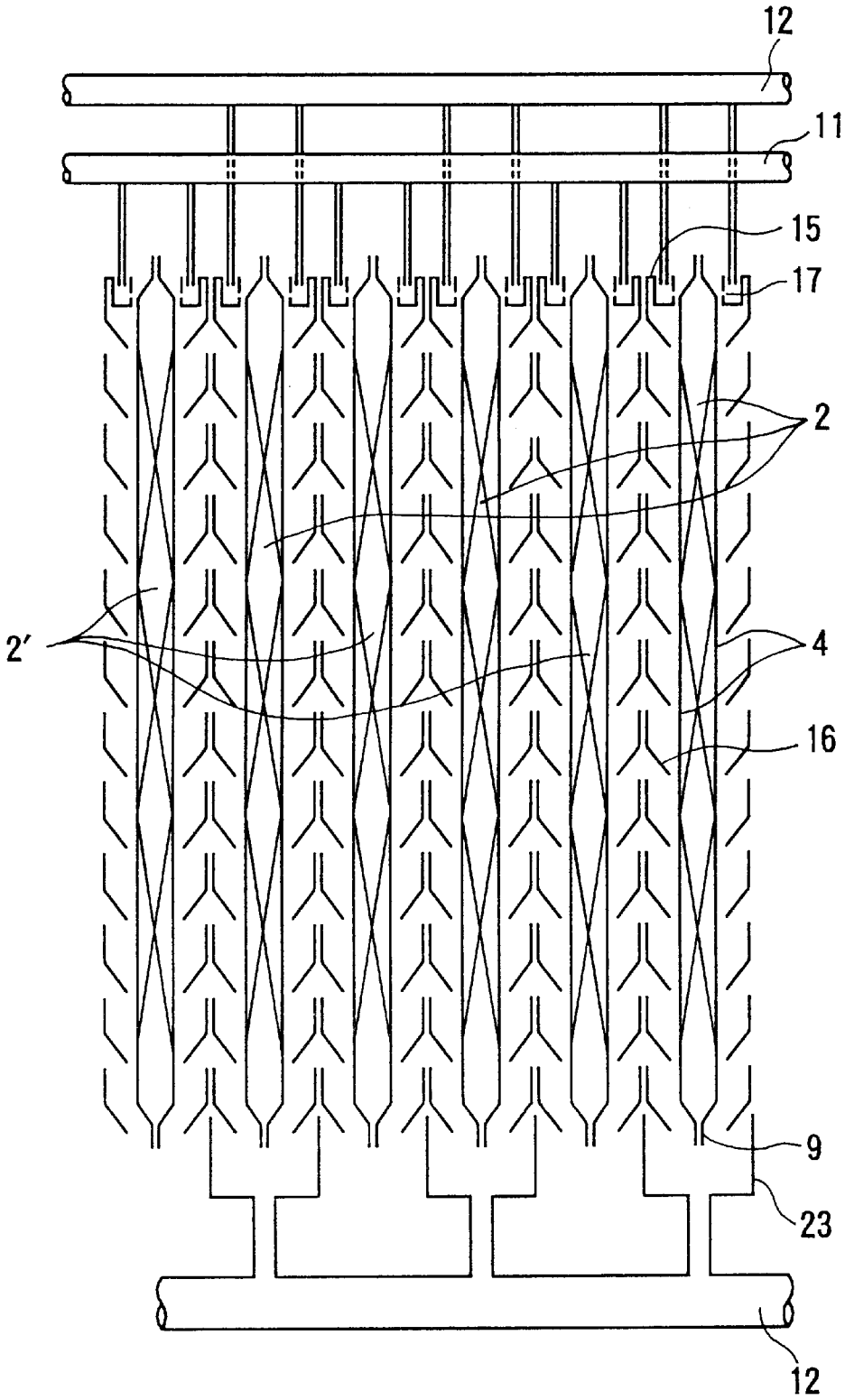
FIG. 11 is a cross-sectional configurational view showing another example of a plate heat exchanger according to a third embodiment of the present invention.

FIG. 11 shows the plate heat exchanger having liquid distributors 15 formed integrally with baffles 16. The configuration shown in FIG. 11 is practically the same as the configuration shown in FIG. 6. The uppermost baffle 16 may be integrated with the liquid distributor 15.

Figure 12:
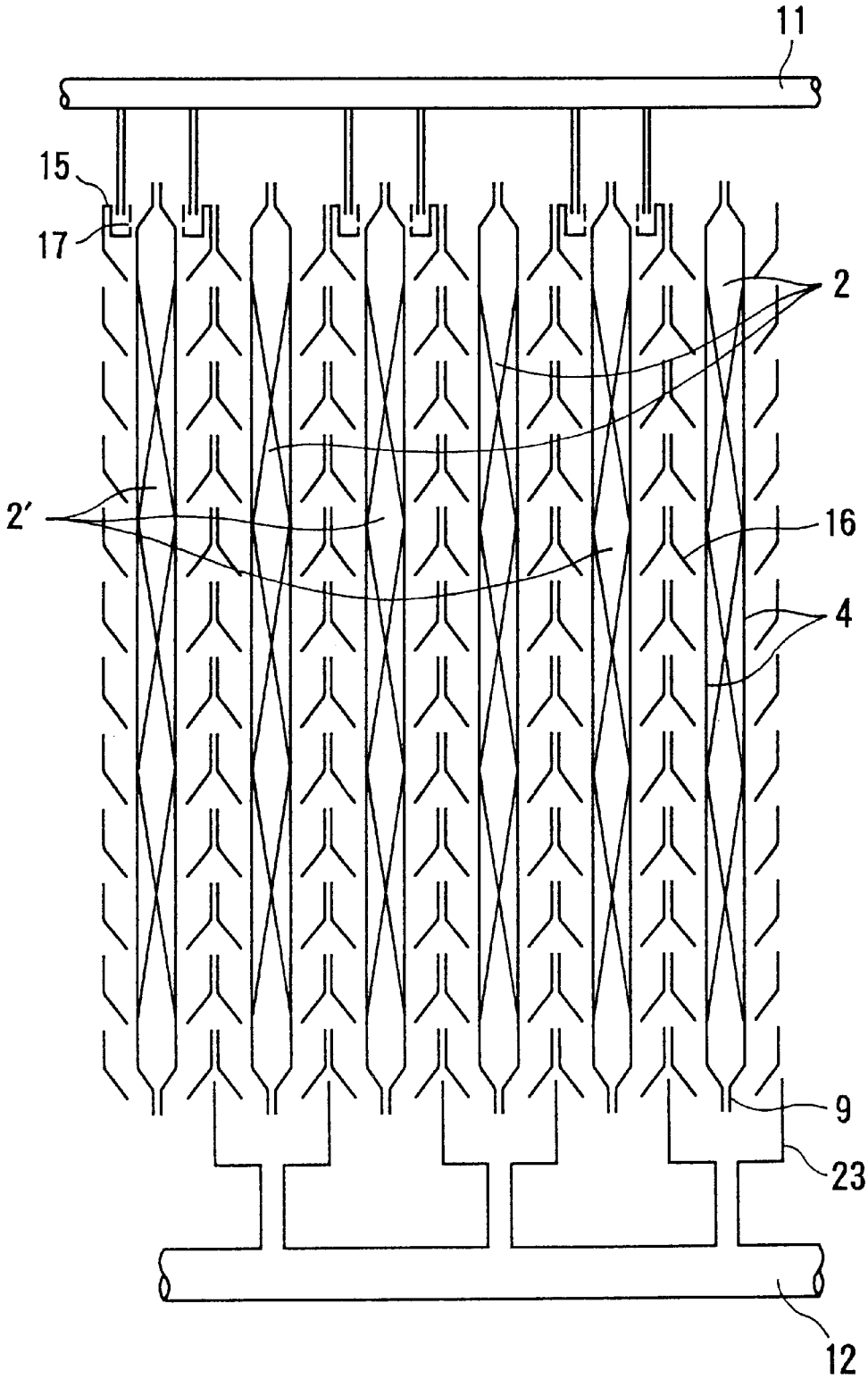
FIG. 12 is a cross-sectional configurational view showing still another example of a plate heat exchanger according to the third embodiment of the present invention.

FIG. 12 shows that the heat exchanger is applied to a combination of a regenerator and a condenser in an absorption refrigerating machine. Cooling water is supplied into a heat exchange element 2 through a communication pipe, while a heat source fluid is supplied into a heat exchange element 2' through a communication pipe. An absorption solution 11 flows on the heat transfer surface of the plate surface of the heat exchange element 2' via a liquid distributor 15 to evaporate a refrigerant liquid and to condense a refrigerant liquid 12 on the heat transfer surface of the plate surface of the heat exchange element 2. The refrigerant liquid 12 which has been condensed is recovered by a refrigerant pan 23. Thus, it is not necessary to provide the liquid distributor on the heat exchange element 2. Even if the liquid distributor is provided, it is not necessary to introduce the liquid into the liquid distributor.

Figure 13A:
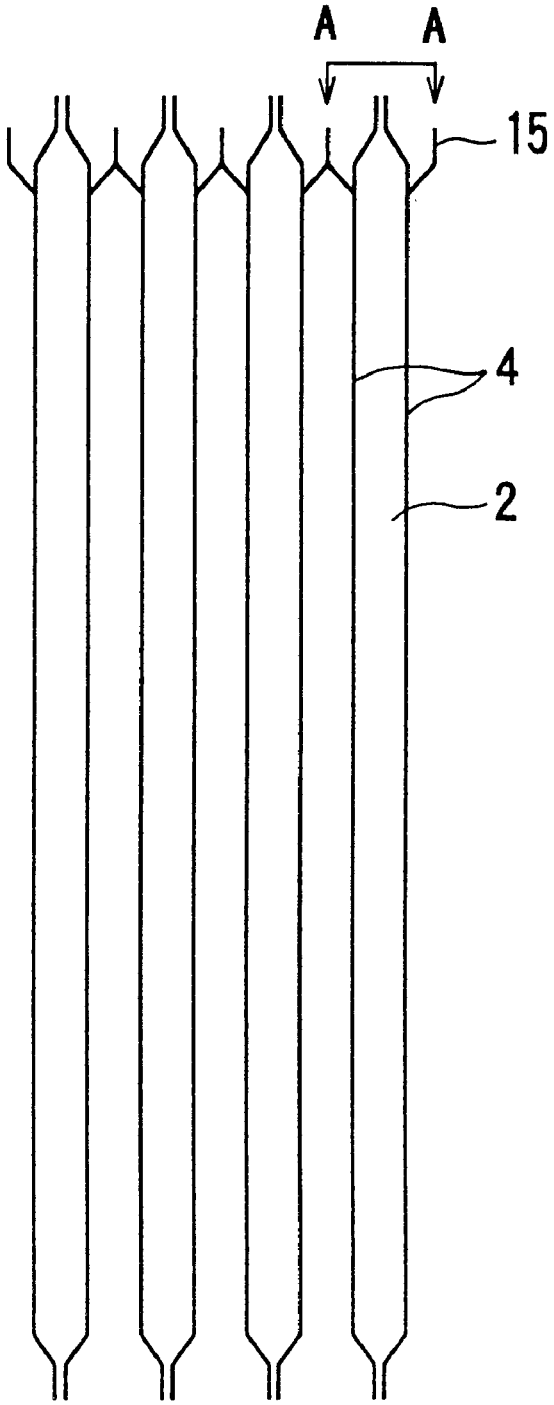
FIGS. 13A and 13B are configurational views schematically showing another example of a plate heat exchanger according to the third embodiment of the present invention.
Figure 13B:
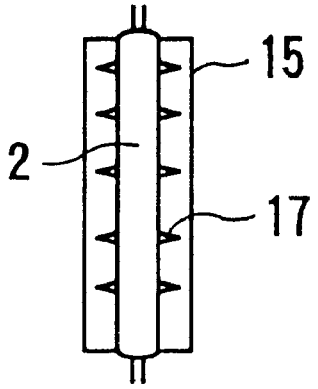
Figure 14:
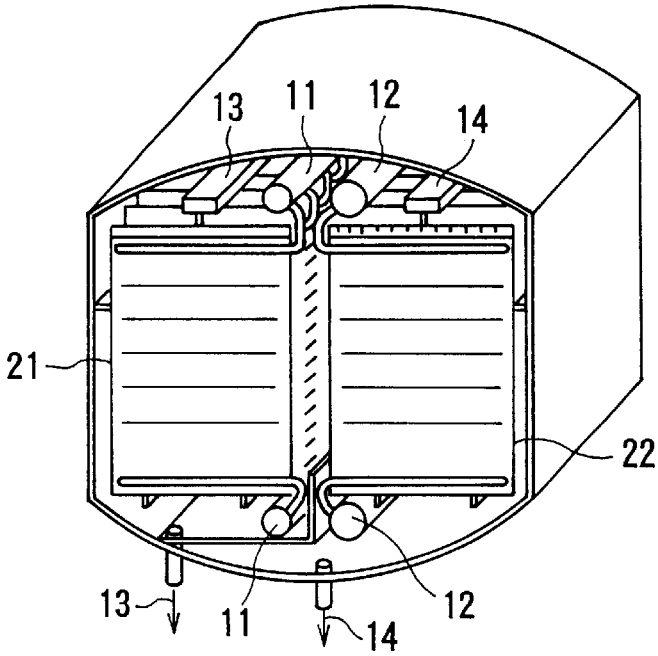
FIG. 14 is a configurational view showing a conventional plate heat exchanger applied to an absorber and an evaporator.
Figure 15:
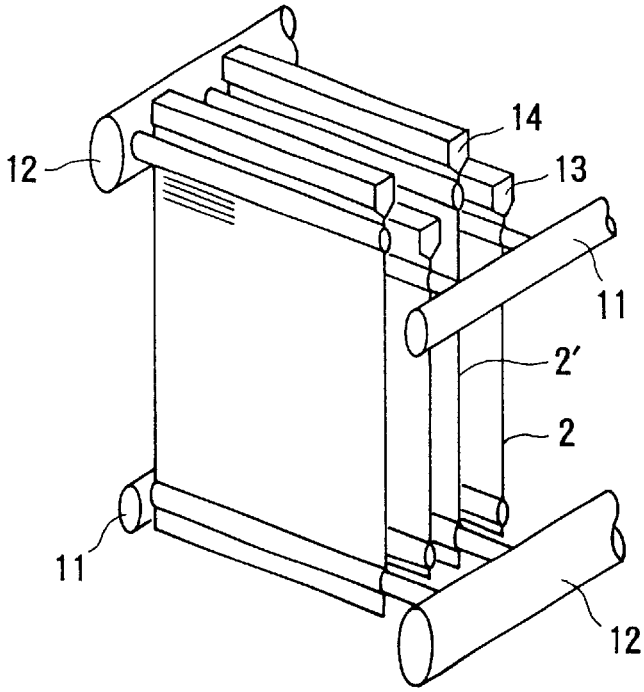
FIG. 15 is a partial configurational view showing a conventional plate heat exchanger applied to an absorber and an evaporator.

FIGS. 13A and 13B are configurational views schematically showing a plate heat exchanger having another liquid distributor according to the present invention. FIG. 13A is a front view, and FIG. 13B is a partial plan view. The configuration shown in FIGS. 13A and 13B is practically the same as the configurations shown in FIGS. 6 and 11. A refrigerant liquid or an absorption solution flows downwardly from orifice holes 17 along the surface of the plate. Thus, the plate surface can also utilized as a gutter-like side surface of a liquid distributor 15. In this case, the orifice holes 17 may be notches provided at a portion to be brought into contact with the plate surface.

As described above, according to the third embodiment of the present invention, passages curved by projections and depressions are formed inside and outside of heat exchange elements composed of one or two types of components, and simultaneously a complicated plate heat exchanger with high efficiency of heat exchanging performance for exchanging heat between two fluids having different temperatures can be manufactured at low cost from a small number of components by a simple manufacturing process.

Further, according to the present invention, since droplets are prevented from being scattered, the two fluids flowing downwardly are not mixed with each other. When the heat exchanger is used as an absorber and an evaporator, or a regenerator and a condenser, in an absorption refrigerating machine, an absorption refrigerating machine with a high heat exchange performance can be obtained without a lowered performance of a refrigerating machine or the problem that the heat transfer surface is difficult to be wet.

Furthermore, according to the present invention, the fluid flowing downwardly on the plate surface can flow evenly without nonuniformity of the liquid flow. Therefore, a plate heat exchanger with high efficiency of heat exchanging performance can be obtained.

INDUSTRIAL APPLICABILITY

The present invention relates to a plate heat exchanger for exchanging heat between two fluids flowing alternately through adjacent fluid passages between piled plates, which is suitable for an evaporator, a low-temperature regenerator, a condenser, and the like in a refrigerating machine using a low-pressure refrigerant.

What is claimed is:

1. A plate heat exchanger for simultaneously exchanging heat between two sets of fluids having different temperatures, including:

a first heat exchange element comprising two first plates facing each other as a set so as to form a sealed inner space therebetween as a passage for a first fluid, wherein a plate surface of each said first plate serves as a heat transfer surface, and a fluid flowing along an outer surface of said first plates is a second fluid; and a second heat exchange element comprising two second plates facing each other as a set so as to form a second sealed inner space as a passage for a third fluid, wherein a plate surface of each said second plate serves as a heat transfer surface, and a fluid flowing along an outer surface of said plate is a fourth fluid;

a plurality of said first heat exchange elements and a plurality of said second heat exchange elements are alternately disposed in such a manner that said plate surface of said respective first and second plates are opposed to each other and a predetermined gap is formed therebetween;

baffles interposed between adjacent heat exchange elements and being operative to direct said second and fourth fluid toward the respective heat exchange elements; and a first communication pipe communicating with said inner spaces of said first heat exchange elements and a second communication pipe communicating with said inner spaces of said second heat exchange elements are formed, as a part of said plate in each said element, on said plate surfaces of said first and second heat exchange elements and formed integrally with said elements; and said first and second heat exchange elements having corresponding shapes and being alternately disposed symmetrically in opposite directions.

2. A plate heat exchanger according to claim 1, wherein said plate heat exchanger defines a plate-type absorber and a plate-type evaporator for an absorption refrigerating machine, in which said first fluid is cooling water, said second fluid is an absorption solution, said third fluid is cold water, and said fourth fluid is a refrigerant liquid.

3. A plate heat exchanger according to claim 1, wherein said plate heat exchanger comprises a plate-type regenerator and a plate-type condenser for an absorption refrigerating machine, in which said first fluid is a heat source fluid, said second fluid is an absorption solution, said third fluid is cooling water, and said fourth fluid is a refrigerant condensate.

4. A plate heat exchanger for simultaneously exchanging heat between two sets of fluids having different temperatures including:

a first heat exchange element comprising two first plates facing each other as a set so as to form a sealed inner space therebetween as a passage for a first fluid. wherein a plate surface of each said first plate serves as a heat transfer surface, and a fluid flowing along an outer surface of said first plates is a second fluid; and a second heat exchange element comprising two second plates facing each other as a set so as to form a second sealed inner space as a passage for a third fluid, wherein a plate surface of each said second plate serves as a heat transfer surface, and a fluid flowing along an outer surface of said plate is a fourth fluid;

a plurality of said first heat exchange elements and a plurality of said second heat exchange elements are alternately disposed in such a manner that said plate surfaces of said respective first and second plates are opposed to each other and a predetermined gap is formed therebetween; and a first communication pipe communicating with said inner spaces of said first heat exchange elements and a second communication pipe communicating with said inner spaces of said second heat exchange elements are formed, as a part of said plate in each said element, on said plate surfaces of said first and second heat exchange elements and formed integrally with said elements; and said first and second heat exchange elements having corresponding shapes and being alternately disposed symmetrically in opposite directions;

wherein scatter preventive means for preventing a droplet from being scattered is provided in said gap.

5. A plate heat exchanger according to claim 4, wherein said scatter preventive means is constituted by two plates cooperating to return a scattered liquid to said heat transfer surface on which said liquid has been scattered.

6. A plate heat exchanger according to claim 4, wherein a liquid distributor for said second fluid or said fourth fluid is disposed on said outer surface of said plate in at least one of said first heat exchange element and said second heat exchange element.

7. A plate heat exchanger for simultaneously exchanging heat between two sets of fluids having different temperatures, including:

a first heat exchange element comprising two first plates facing each other as a set so as to form a sealed inner space therebetween as a passage for a first fluid, wherein a plate surface of each said first plate serves as a heat transfer surface, and a fluid flowing along an outer surface of said first plates is a second fluid; and a second heat exchange element comprising two second plates facing each other as a set so as to form a second sealed inner space as a passage for a third fluid, wherein a plate surface of each said second plate serves as a heat transfer surface, and a fluid flowing along an outer surface of said plate is a fourth fluid;

a plurality of said first heat exchange elements and a plurality of said second heat exchange elements are alternately disposed in such a manner that said plate surfaces of said respective first and second plates are opposed to each other and predetermined gap is formed therebetween; and a first communication pipe communicating with said inner spaces of said first heat exchange elements and a second communication pipe communicating with said inner spaces of said second heat exchange elements are formed as a part of said plate in each said element, on said plate surfaces of said first and second heat exchange elements and formed integrally with said elements; and said first and second heat exchange elements having corresponding shapes and being alternately disposed symmetrically in opposite directions; and wherein a liquid distributor for flowing said second fluid and said fourth fluid onto upper portions of surfaces of said first and second heat exchange elements is provided in said gap.

8. A plate heat exchanger for simultaneously exchanging heat between two sets of fluids having different temperatures, including;

a first heat exchange element comprising two first plates facing each other as a set so as to form a sealed inner space therebetween as a passage for a first fluid, wherein a plate surface of each said first plate serves as a heat transfer surface, and a fluid flowing along an outer surface of said first plates is a second fluid; and a second heat exchange element comprising two second plates facing each other as a set so as to form a second sealed inner space as a passage for a third fluid, wherein a plate surface of each said second plate serves as a heat transfer surface, and a fluid flowing along an outer surface of said plate is a fourth fluid;

a plurality of said first heat exchange elements and a plurality of said second heat exchange elements are alternately disposed in such a manner that said plate surfaces of said respective first and second plates are opposed to each other and a predetermined gap is formed therebetween; and a first communication pipe communicating with said inner spaces of said first heat exchange elements and a second communication pipe communicating with said inner spaces of said second heat exchange elements are formed, as a part of said plate in each said element, on said plate surfaces of said first and second heat exchange elements and formed integrally with said elements; and said first and second heat exchange elements having corresponding shapes and being alternately disposed symmetrically in opposite directions, wherein a liquid distributor comprising a gutter having an orifice hole in a side surface thereof for flowing said second fluid and said fourth fluid onto upper portions of surfaces of said first and second heat exchange elements is provided in said gap.

9. A plate heat exchanger for simultaneously exchanging heat between two sets of fluids having different temperatures, including:

a first heat exchange element comprising two first plates facing each other as a set so as to form a sealed inner space therebetween as a passage for a first fluid, wherein a plate surface of each said first plate serves as a heat transfer surface, and a fluid flowing along an outer surface of said first plates is a second fluid; and a second heat exchange element comprising two second plates facing each other as a set so as to form a second sealed inner space as a passage for a third fluid, wherein a plate surface of each said second plate serves as a heat transfer surface, and a fluid flowing along an outer surface of said plate is a fourth fluid;

a plurality of said first heat exchange elements and a plurality of said second heat exchange elements are alternately disposed in such a manner that said plate surfaces of said respective first and second plates are opposed to each other and a predetermined gap is formed therebetween;

a first communication pipe communicating with said inner spaces of said first heat exchange elements and a second communication pipe communicating with said inner spaces of said second heat exchange elements are formed, as a part of said plate in each said element, on said plate surfaces of said first and second heat exchange elements and formed integrally with said elements; and said first and second heat exchange elements having corresponding shapes and being alternately disposed symmetrically in opposite directions, wherein a liquid distributor in the form of a gutter for flowing said second fluid and said fourth fluid onto upper portions of surfaces of said first and second heat exchange elements is provided in said gap, and said plate surface is utilized as a side surface of said gutter.

* * * * *

UNITED STATES PATENT AND TRADEMARK OFFICE

CERTIFICATE OF CORRECTION

PATENT NO. : 6,817,406 B1
DATED : November 16, 2004
INVENTOR(S) : Naoyuki Inoue et al.

It is certified that error appears in the above-identified patent and that said Letters Patent is hereby corrected as shown below:

Title page,
Item [54], Title, please change from "PLATE TYPE HEAT EXCHANGER" to
-- PLATE HEAT EXCHANGER --

Signed and Sealed this

Twenty-first Day of June, 2005

JON W. DUDAS
*Director of the United States Patent and Trademark Office*